US008021199B2

(12) United States Patent
Ambo et al.

(10) Patent No.: US 8,021,199 B2
(45) Date of Patent: Sep. 20, 2011

(54) ELECTRICAL CONNECTOR HAVING LARGE LOCKING FORCE

(75) Inventors: Tsugio Ambo, Saitama (JP); Yoshikazu Tanaka, Saitama (JP); Tetsu Hirose, Saitama (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 12/673,856

(22) PCT Filed: Aug. 14, 2008

(86) PCT No.: PCT/JP2008/064640

§ 371 (c)(1),
(2), (4) Date: May 4, 2010

(87) PCT Pub. No.: WO2009/025242

PCT Pub. Date: Feb. 26, 2009

(65) Prior Publication Data

US 2010/0210144 A1 Aug. 19, 2010

(30) Foreign Application Priority Data

Aug. 20, 2007 (JP) ..... 2007-213688

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS

| | | | | |
|---|---|---|---|---|
| 5,201,674 | A * | 4/1993 | Okura | 439/595 |
| 5,573,432 | A * | 11/1996 | Hatagishi | 439/752 |
| 5,683,272 | A * | 11/1997 | Abe | 439/747 |
| 6,019,625 | A * | 2/2000 | Nimura et al. | 439/259 |
| 6,296,530 | B1 * | 10/2001 | Yoneda et al. | 439/701 |

FOREIGN PATENT DOCUMENTS

| | | | |
|---|---|---|---|
| FR | 2 831 721 | A1 | 5/2003 |
| JP | 9-213402 | A | 8/1997 |
| JP | 2003-142194 | A | 5/2003 |
| JP | 2004-39535 | A | 2/2004 |

OTHER PUBLICATIONS

English Language International Search Report dated Sep. 9, 2008, issued in parent Appln. No. PCT/JP2008/064640.

* cited by examiner

*Primary Examiner* — Hae Moon Hyeon

(74) *Attorney, Agent, or Firm* — Holtz, Holtz, Goodman & Chick, PC

(57) ABSTRACT

An electric connector capable of fixing a small connection terminal by a large locking force. Two housings having a plurality of connection terminals are placed vertically symmetrically with their open surfaces facing each other, and a holder having a lock is interposed between the open surfaces of the housings. An assembly of the housings and the holder is accommodated in an outer cover, and a bottom cover is fixed to the bottom of the outer cover. The connection terminals are rigidly prevented from moving backward and vertically by the housings and the holder, and from moving forward by a front wall of the outer cover.

11 Claims, 9 Drawing Sheets

ELECTRICAL CONNECTOR HAVING LARGE LOCKING FORCE

CROSS-REFERENCE TO RELATED APPLICATION

This application is a U.S. National Phase Application under 35 USC 371 of International Application PCT/JP2009/025242 filed Feb. 26, 2007.

FIELD OF THE INVENTION

The present invention relates to an electrical connector accommodating connecting terminals of small size.

BACKGROUND OF THE INVENTION

Connecting terminals for connecting electric circuits in automobiles have been miniaturized for decreasing weight of automobiles.

The connecting terminals accommodated within a housing are generally locked at position by means of resilient locking lances provided in the housing.

DISCLOSURE OF THE INVENTION

Problems to be Solved by the Invention

However, when the connecting terminals are extremely miniaturized, it is difficult to form very small lances in the housing by injection molding. Furthermore, the extremely small lances could not have a sufficiently large locking force.

In order to solve such a problem, a patent document 1 discloses an electrical connector in which a rear holder is fixed at a rear portion to couple a rear holder 1 shown in FIG. 18 and small lances 2 are formed in the rear holder 1 such that each lances correspond to respective connecting terminals.

However, even in such a structure, when a pitch distance of connecting terminals is short such as 1.5 mm, extremely miniaturized lances 2 having a sufficiently large locking force could not be formed easily by molding

[Patent document 1] Japanese Patent Application Laid-open Publication Kokai 2004-39535

The present invention has for its object to provide an electrical connector which can remove the above mentioned drawback and miniaturized connecting terminals which can be fixed at position with a large locking force.

Means for Solving the Problems

According to the invention, in order to achieve the above mentioned object, an electrical connector comprises a housing having a plurality of tubular portions formed in a front portion thereof and an open surface formed in one surface of a rear portion of the housing, each of said tubular portions being formed to hold a base portion of a connecting terminal and said rear portion being formed to install clamp portions of said connecting terminals; a holder for closing said open surface of the housing and having formed therein locking portions for preventing said connecting terminals from moving in a backward direction; and an outer cover for covering an assembly of said housing having the connecting terminals installed therein and said holder.

Merits of the Invention

In the electrical connector according to the invention, since the conventional locking lances are not used and the holder has the locking portions, even when the connecting terminals are extremely miniaturized, the connecting terminals can be locked at position with a very large locking force by means of the holder having the locking portions.

EXPLANATION OF THE REFERENCE NUMERALS

Figure 1:
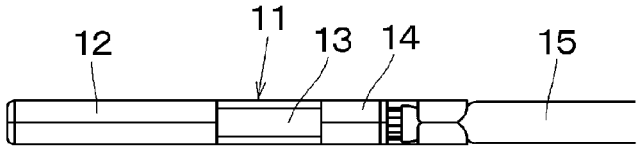
FIG. 1 is a plan view showing a connecting terminal.

11 connecting terminal
12 contact portion
13 middle portion
14 clamp portion
15 electric wire
16 cut-out portion
21 housing
22 tubular portion having rectangular cross section
26, 34 partition wall
31 holder
32 base plate
33 locking portion
41 outer cover
42 bottom cover

BEST MODES OF THE INVENTION

Now the present invention will be explained in detail with reference to embodiments shown in FIGS. 1-17 of the attached drawings.

Figure 2:
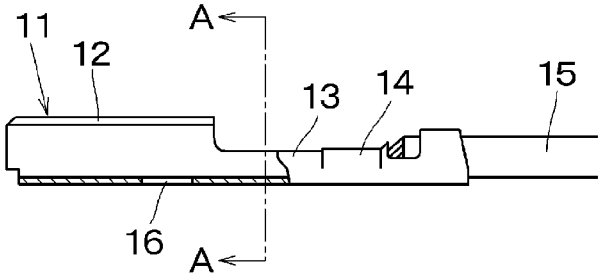
FIG. 2 is a longitudinal cross sectional view of the connecting terminal partially cut out.
Figure 3:
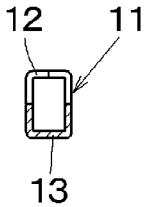
FIG. 3 is a lateral cross sectional view cut along a line A-A in FIG. 2.

FIG. 1 is a plan view and FIG. 2 is a partial cross sectional view showing a connecting terminal, and FIG. 3 is a lateral cross sectional view cut along a line A-A in FIG. 2. The connecting terminal 11 is formed by punching and folding an electrically conductive metal plate. The connecting terminal 11 includes a tubular contact portion 12 formed at a front portion, a middle portion 13 and a clamp portion 14 formed at a rear portion. A cooperating contact terminal is to be inserted into the tubular contact portion 12, and an electric wire 15 is connected to the clamp portion 14. A cut-out portion 16 is formed in a bottom of the contact portion 12.

Figure 4:
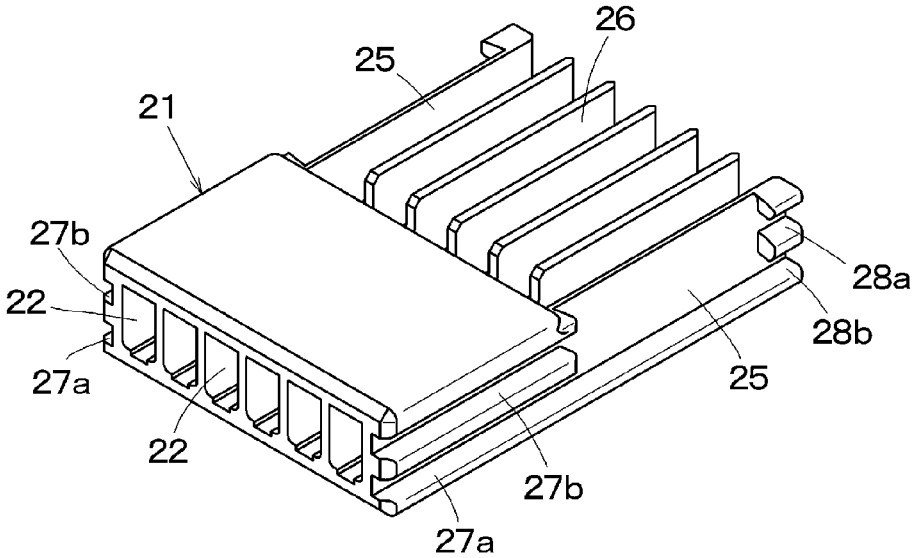
FIG. 4 is a perspective view showing a housing.
Figure 5:
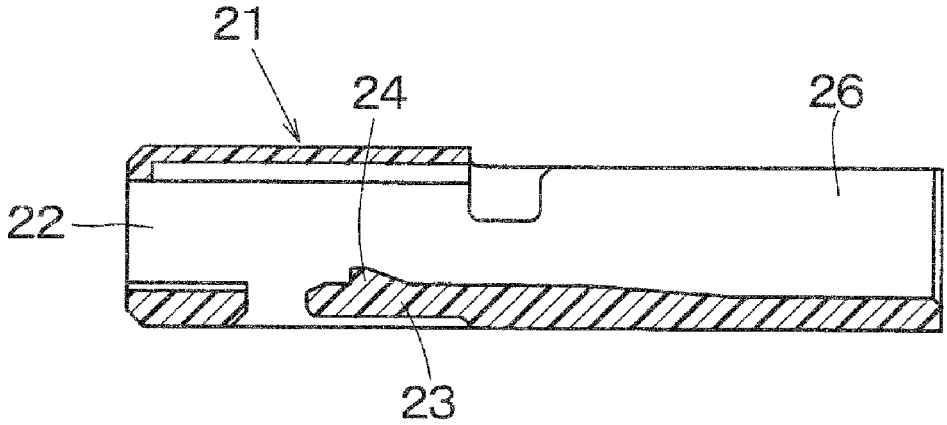
FIG. 5 is a longitudinal cross sectional view of the housing.
Figure 6:
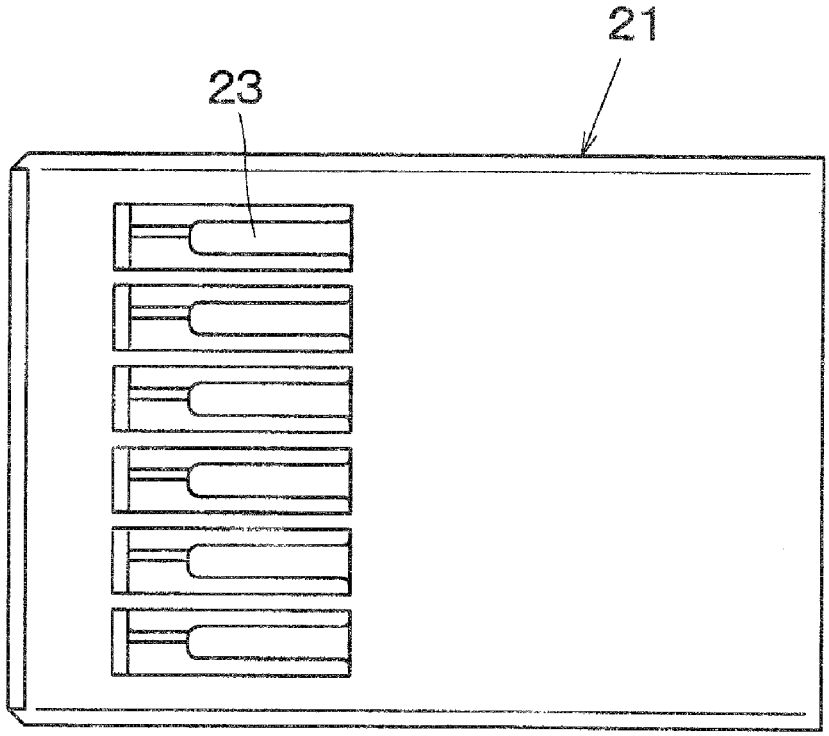
FIG. 6 is a bottom view of the housing.

FIGS. 4, 5 and 6 are a perspective view, a lateral cross sectional view and a bottom view, respectively showing a housing 21 made of synthetic resin. In the present embodiment, two housings 21 are used. The housing 21 is formed to accommodate six connecting terminals 11. At a front portion of the housing 21, there are formed six tubular portions 22 having a rectangular cross section, the tubular portions 22 being aligned in a longitudinal direction and accommodating the contact portions 12 of the connecting terminals 11. In a bottom of the tubular portion 22 there is formed a resilient portion 23, and a claw portion 24 is formed on an inner surface of the resilient portion 23, the claw portion 24 having an upright front wall and an inclined surface descending from the upright front wall toward the rear portion.

One side of a rear half portion of the housing 21 is opened and side plates 25 are provided at both sides thereof. Between the side plates 25 there are formed five partition walls 26 extending in the longitudinal direction to define six terminal accommodating spaces. On both sides of the tubular portions 22 of the housing 21 and in outer surfaces of the side plates 25, there are formed two engaging grooves 27*a*, 27*b* and 28*a*, 28*b*, respectively, the two engaging grooves being arranged one on the other toward the longitudinal direction.

Figure 7:
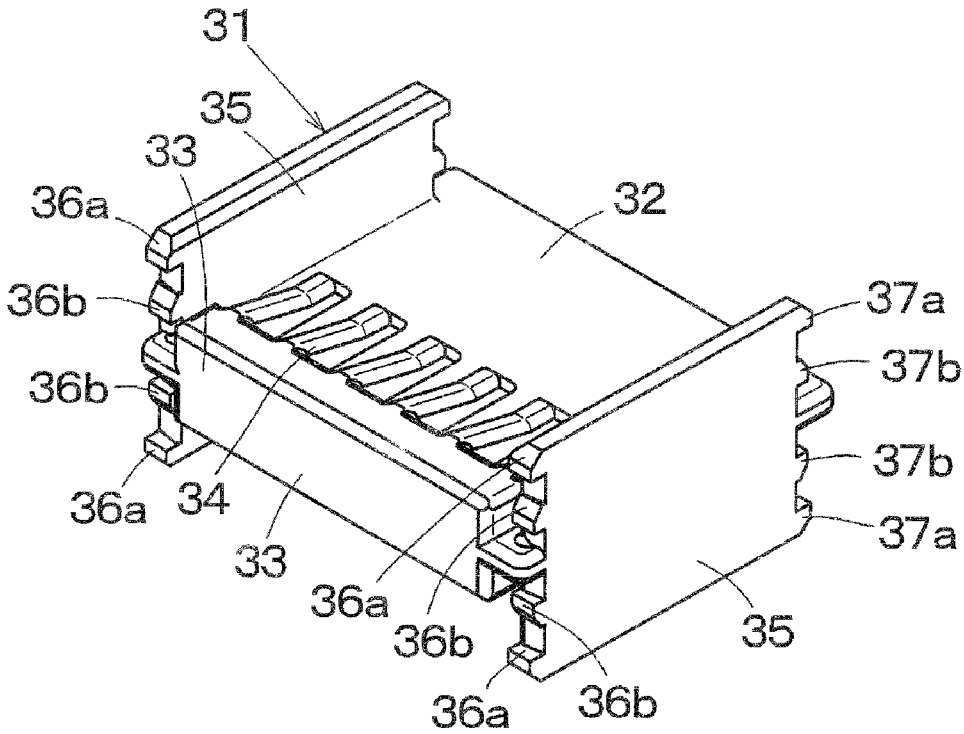
FIG. 7 is a perspective view depicting a holder.
Figure 8:
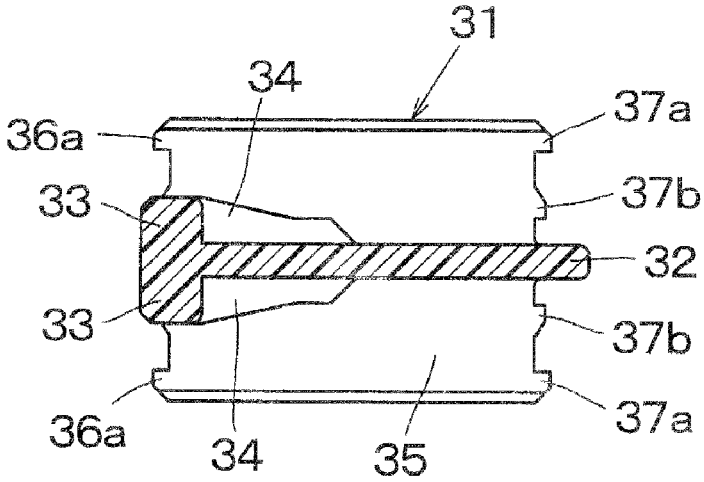
FIG. 8 is a longitudinal cross sectional view of the holder.

FIGS. 7 and 8 are a perspective view and a longitudinal cross sectional view, respectively illustrating a holder 31 made of a synthetic resin. The holder 31 includes a base plate 32, and locking portion 33 formed at a front end of the base plate 32, the locking portion 33 being formed as an upright wall extending from upper and lower surfaces of the base plate 32 such that the locking portion 33 being engaged with rear ends of the contact portions 12 of the connecting terminals 11 to prevent undesired backward movement of the connecting terminals 11. Moreover, on the upper and lower surfaces of the base plate 32 there are formed partition walls 34 for separating the connecting terminals 11.

On both sides of the base plate 32 there are formed side plates 35, and at front and rear portions of the side plates 35 there are provided engaging portions 36*a*, 36*b* and 37*a*, 37*b* formed as claws, the engaging portions 36*a*, 36*b* and 37*a*, 37*b* being engaged with the engaging grooves 27*a*, 27*b* and 28*a*, 28*b* of the housing 21. The engaging portions 36*a*, 36*b*, 37*a* and 37*b* are arranged one on the other.

Figure 9:
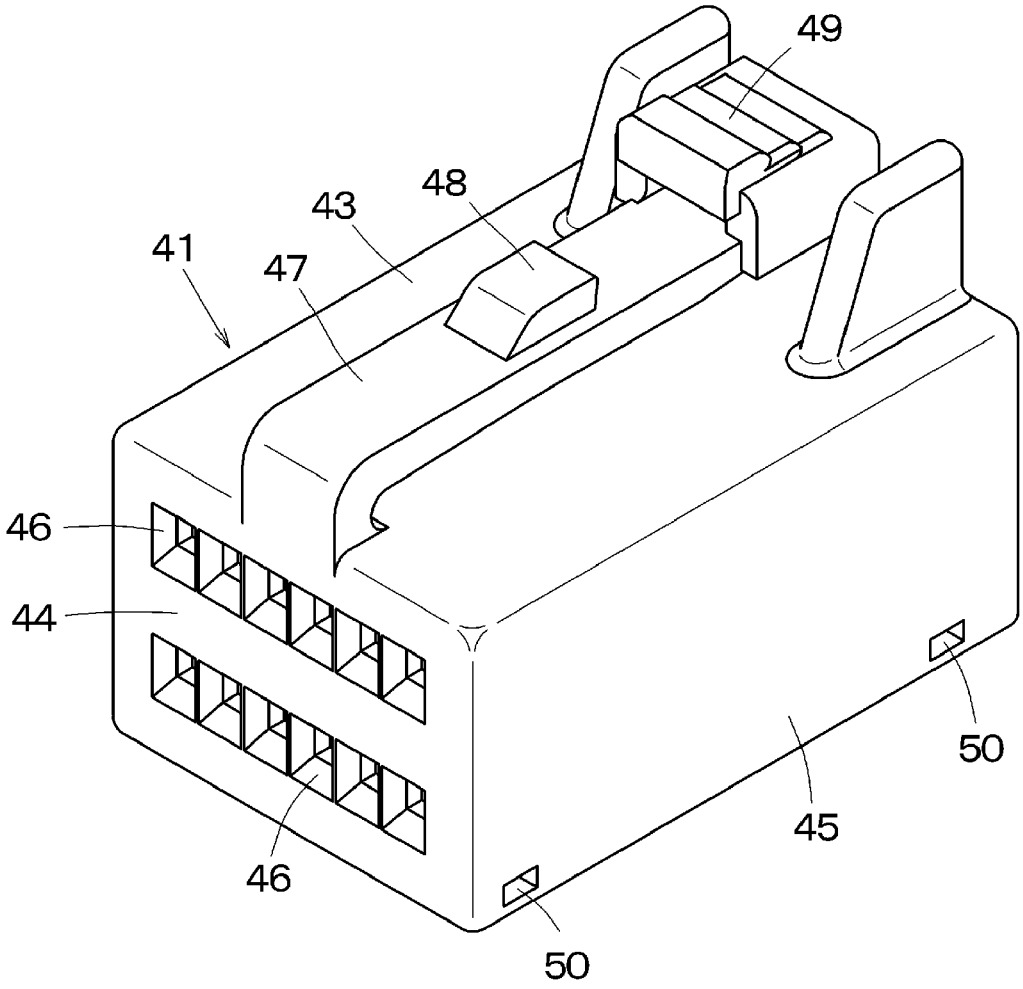
FIG. 9 is a perspective view showing an outer cover.
Figure 10:
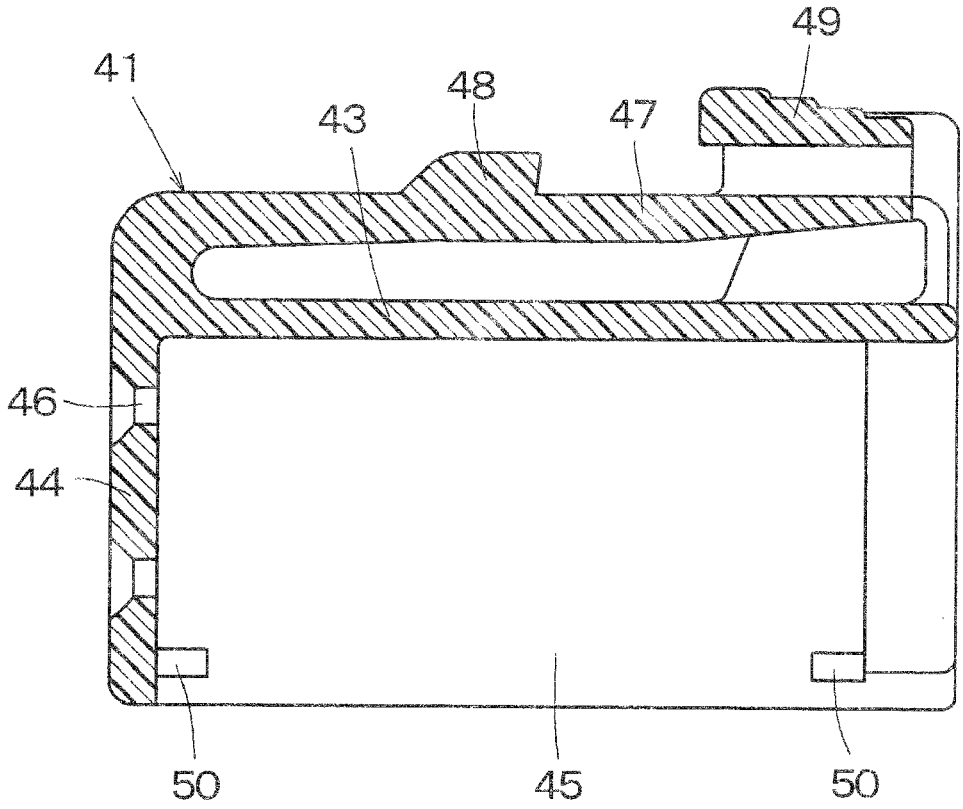
FIG. 10 is a longitudinal cross sectional view of the outer cover.
Figure 11:
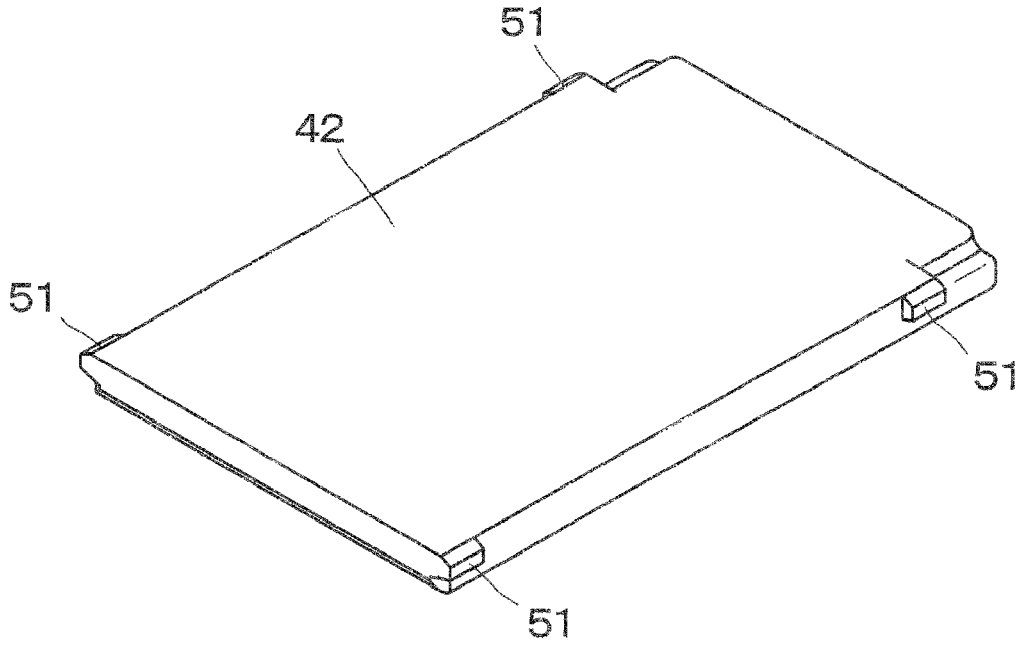
FIG. 11 is a perspective view depicting a bottom cover.

FIGS. 9 and 10 are a perspective view and a longitudinal cross sectional view, respectively showing an outer cover 41 made of a synthetic resin, and FIG. 11 is a perspective view depicting a bottom cover 42 made of a synthetic resin. The outer cover 41 has an upper wall 43, front wall 44 and side walls 45 formed integrally as a unit body. In the front wall 44 of the outer cover 41 there are formed two arrays of terminal insertion holes 46 one on the other, each array including six terminal insertion holes. Upon assembling the electrical connector, contact portions of connecting terminals of a cooperating electrical connector are inserted into the terminal insertion holes 46. On an upper surface of the upper wall 43 there is formed locking lever 47 which is to be engaged with an outer cover of the cooperating electrical connector. On the locking lever 47 there are formed a locking projection 48 and a pushing portion 49 for operating the locking lever 47.

In four lower corners of the side walls 45 of the outer cover 41 there are formed openings 50 for locking the bottom cover 42, and on side edges of the bottom cover 42 there are formed projections 51 which are to be inserted into the openings 50 of the outer cover 41.

Figure 12:
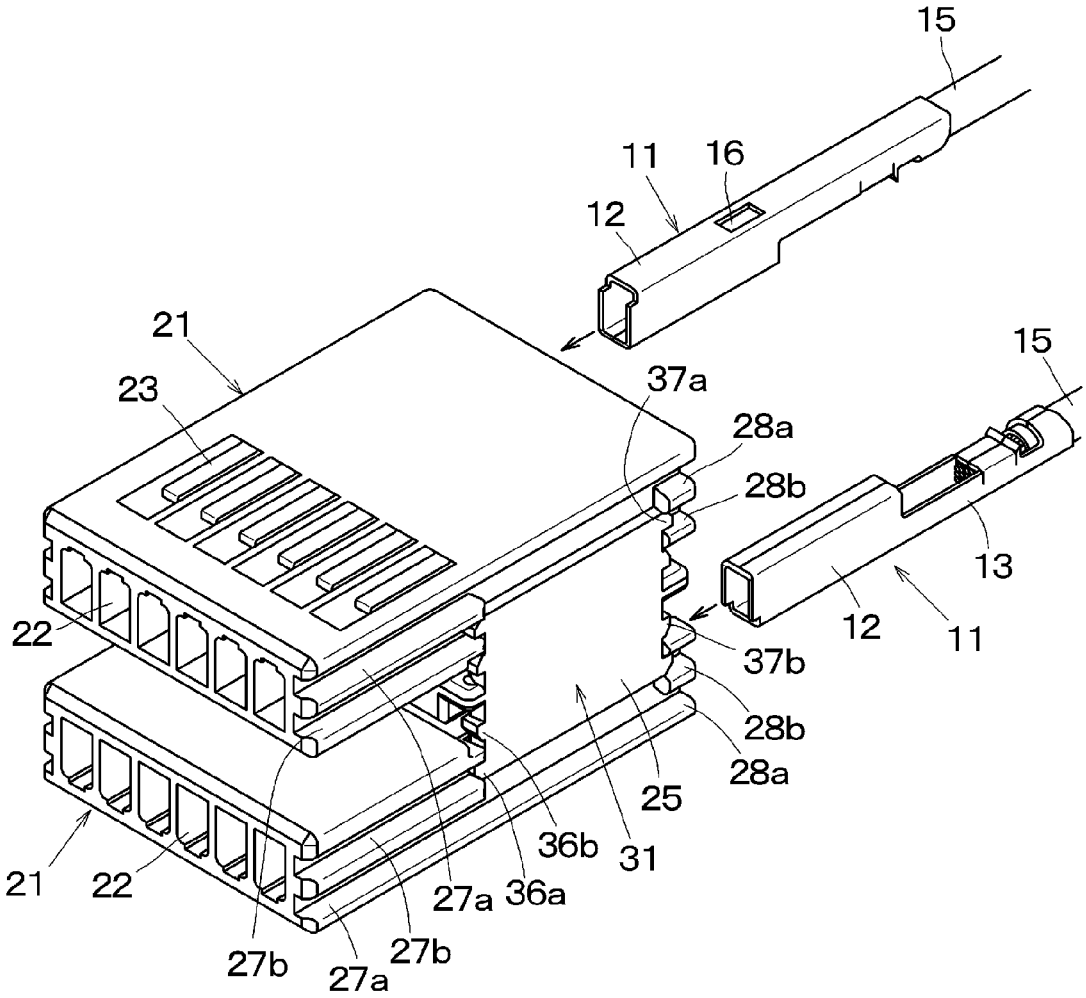
FIG. 12 is a perspective view in which the housing and the holder are temporally engaged.

As shown in FIG. 12, two housings 21 are arranged such that the open sides of the housings 21 are faced each other in a vertical direction, and the holder 31 is arranged between the two housings 21. In this condition, the engaging portions 36*a* and 37*a* formed on the side walls 35 of the holder 31 are inserted into the engaging grooves 27*b* and 28*b*, respectively of the housings 21 to attain a temporarily engagement of the housings and holder.

Figure 13:
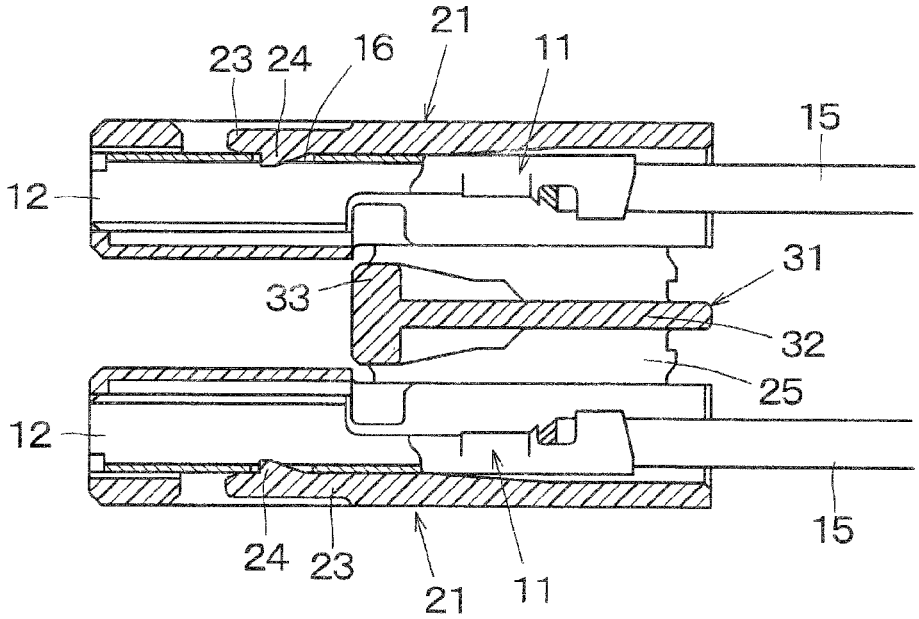
FIG. 13 is a longitudinal cross sectional view in which the connecting terminals are accommodated into the housing.

In this temporarily engagement condition, the connecting terminal 11 is inserted into the housing 21 from the rear portion thereof such that the contact portion 12 provided at the front portion of the connecting terminal 11 is fully inserted into the tubular portion 22 of the housing 21 while the partition wall 26 serves as a insertion guide. As shown in FIG. 13, when the contact portion 12 having a rectangular cross section is inserted into the tubular portion 22 having a rectangular cross section, undesired movement of the connecting terminal 11 in any direction perpendicular to the longitudinal direction of the connecting terminal 11 can be effectively prevented, and at the same time the claw portion 24 of the housing 21 is inserted into the cut-out portion 16 of the connecting terminal 11 such that the connecting terminal 11 is locked within the housing 21.

Figure 14:
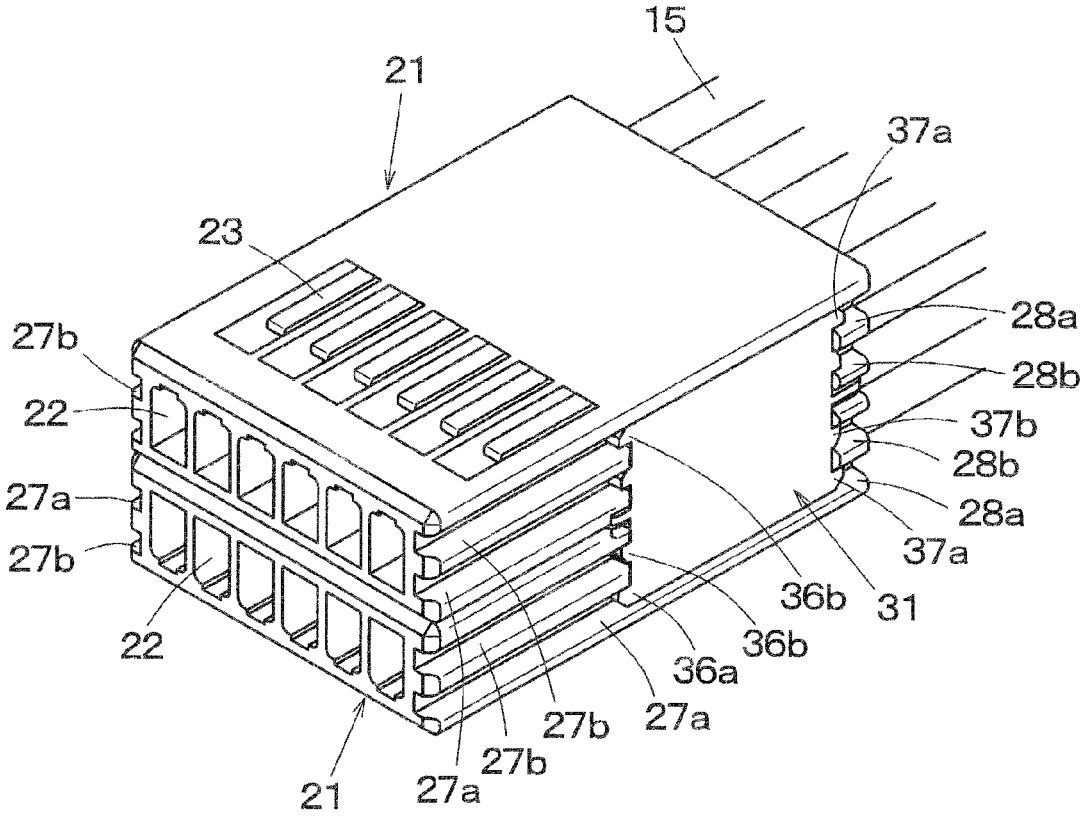
FIG. 14 is a perspective view in which the housing and the holder are finally engaged.

In this condition, the housings 21 are pushed toward the holder 31 such that the open sides of the housings 21 are closed as illustrated in FIG. 14. During this pushing operation, the engaging portions 36*a*, 36*b* and 37*a*, 37*b* of the holder 31 are inserted into the engaging grooves 27*a*, 27*b* and 28*a*, 28*b*, respectively of the housing 21 to couple the housings 21 and the holder 31 each other.

Figure 15:
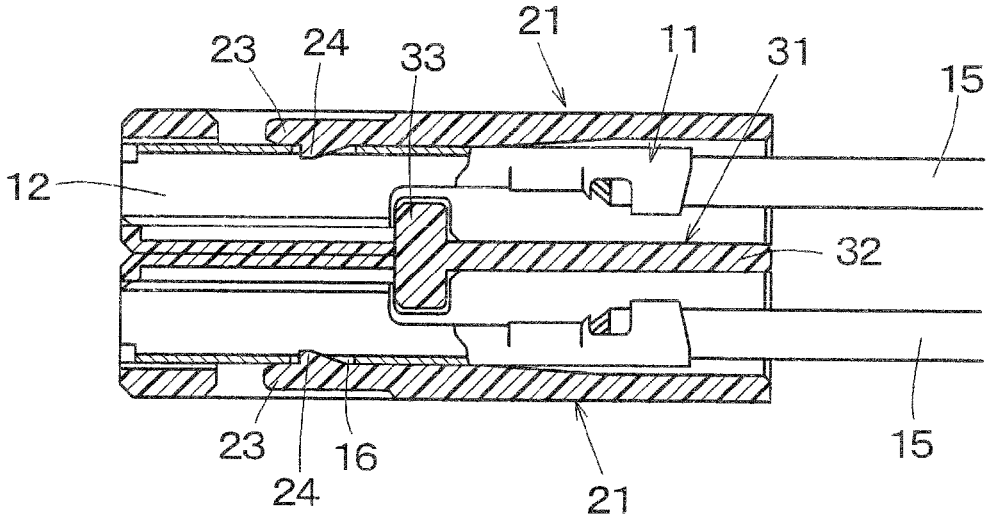
FIG. 15 is a longitudinal perspective view in which the housing and the holder are finally engaged.

In this manner, the two housings 21 having the connecting terminals 11 accommodated therein and the holder 31 are finally engaged with each other, and the locking portion 33 of the holder 31 is brought into contact with the rear steps of the contact portions 12 of the connecting terminals 11 as clearly shown in FIG. 15 to prevent undesired backward movement of the connecting terminals 11.

Figure 16:
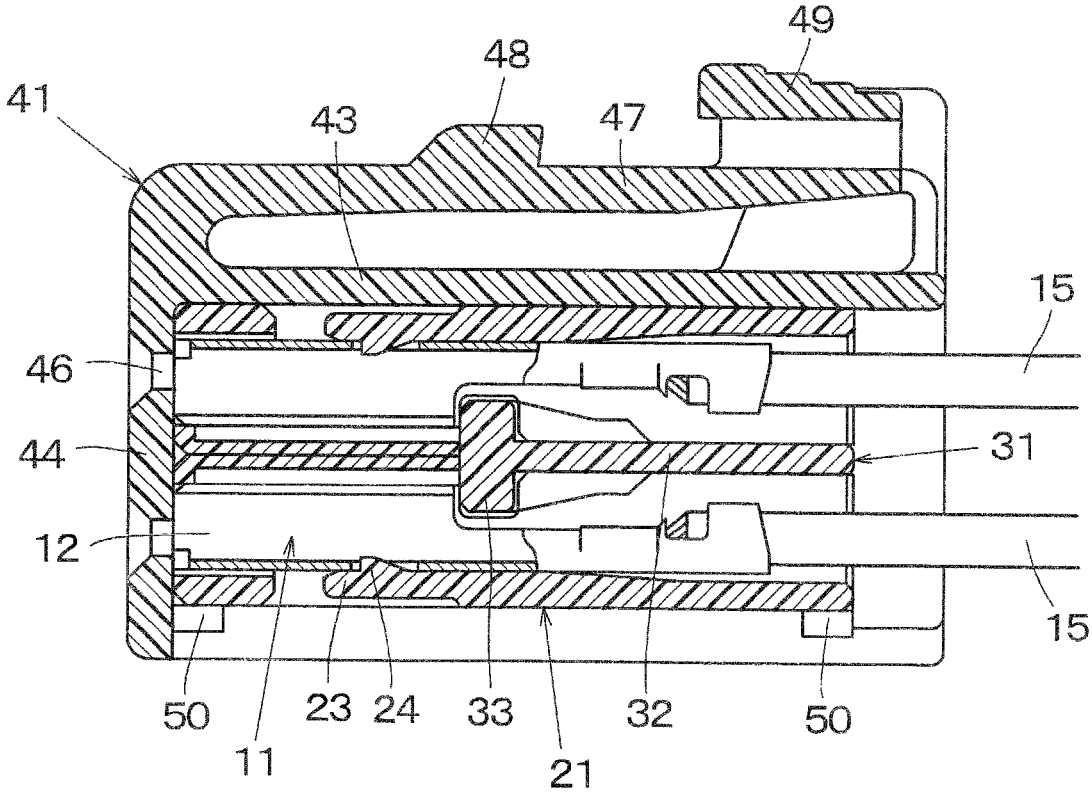
FIG. 16 is a longitudinal perspective view in which an assembly of the housing and the holder is fixed to the outer cover.
Figure 17:
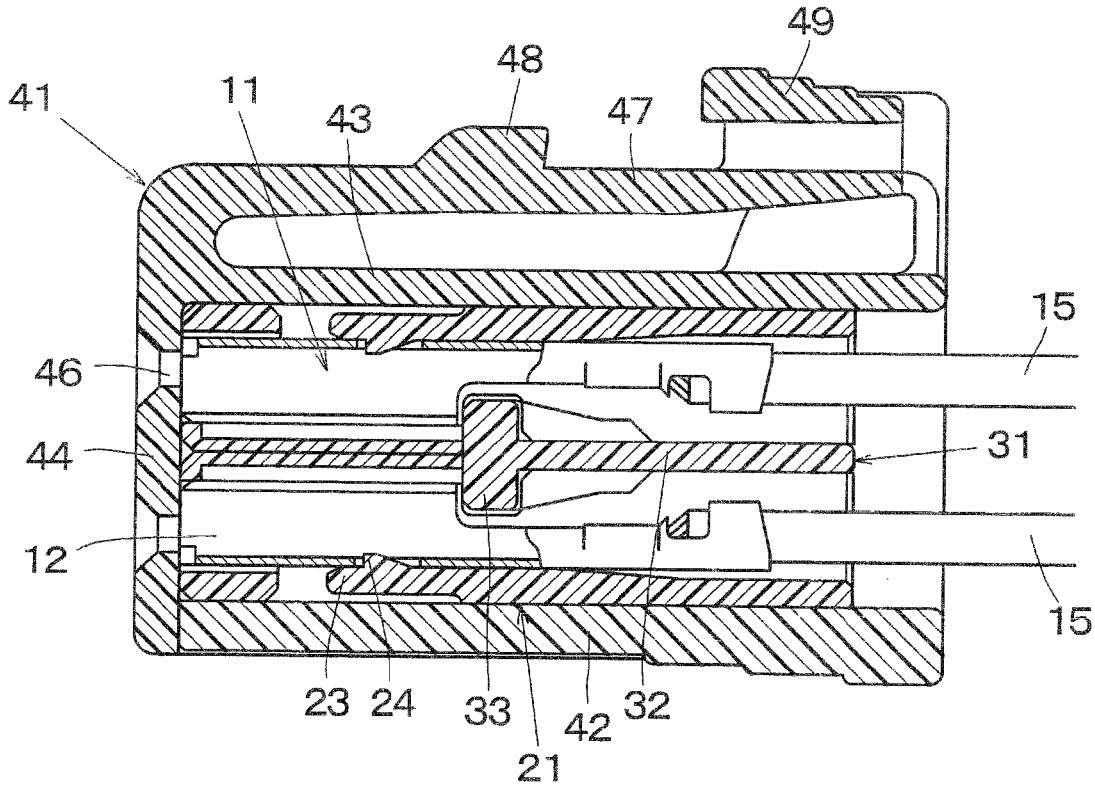
FIG. 17 is a longitudinal perspective view illustrating the outer cover having the bottom cover.
Figure 18:
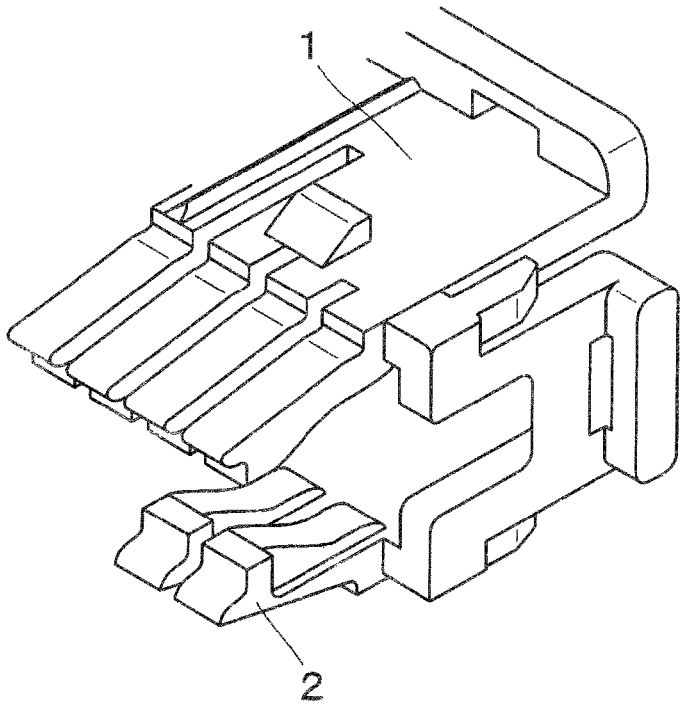
FIG. 18 is a perspective view of a rear holder showing a conventional electrical connector.

Then, an assembly of the housings 21 having the connecting terminals 11 installed therein and the holder 31 is inserted into the outer cover 41 as illustrated in FIG. 16 and the assembly of the housings 21 and holder 31 is fixed within the outer cover 41 by means of a suitable locking mechanism not shown. After that, the bottom cover 42 is secured to the outer cover 41 as depicted in FIG. 17 by means of the openings 50 and projections 51. It should be noted that the bottom cover 42 may be formed as a unit body, in which the bottom cover 42 is hinged to the outer cover 41. Undesired forward movement of the connecting terminals 11 can be prevented by the front wall 44 of the outer cover 41.

In this final engagement condition, undesired movement of the connecting terminals 11 in the forward and backward directions as well as the up and down direction can be effectively prevented by the housings 21, holder 31 and outer cover 41. When the electrical connector is coupled with the cooperating electrical connector by means of the locking lever 47, the connecting terminals of the both electrical connectors are connected to each other to attain a stable electrical connection.

In the embodiment just explained above, the two housings 21 are arranged on upper and lower sides of the holder 31, but according to the invention, only one housing may be arranged on upper or lower side of the holder. In such a case, it is sufficient to provide the locking portion 33 projecting in the upper or lower direction. Moreover, the outer cover 41 may be formed in any shape in accordance with respective applications.

INDUSTRIAL APPLICABILITY

In the embodiment so far explained, the female type connecting terminal 11 is fixed to the housing 21, but according to the invention, a male type connecting terminal may be applicable to a connector consisting of the same components.

The invention claimed is:

1. An electrical connector comprising:

a plurality of connecting terminals each having a contact portion to be connected to a cooperating connecting terminal and a clamp portion to which an electric wire is to be connected;

two housings each having a plurality of tubular portions formed in a front portion of the housing for holding the contact portions of said connecting terminals and an open surface formed in one surface of a rear portion of the housing for arranging the clamp portions of said connecting terminals;

a single holder for closing said open surfaces of said two housings, wherein locking portions are formed in upper and lower surfaces of the holder for preventing said connecting terminals from moving in a backward direction; and a single outer cover for covering said two housings;

wherein the contact portions of said connecting terminals are inserted into the tubular portions of said two housings, being guided by a plurality of partition walls, from the rear portion of each of said two housings to prevent up and down movement of said connecting terminals, and wherein each connecting terminal is temporally engaged by clamping a claw portion of a resilient strip, included in a corresponding tubular portion, into a cut-out portion of the corresponding contact portion, and then, final engagement is accomplished by pushing each housing into said holder, thereby closing the open surface of each housing and preventing undesired backward movement of said connecting terminals.

2. The electrical connector according to claim 1, wherein the plurality of partition walls are provided on said open surface of each housing for separating the connecting terminals from each other.

3. The electrical connector according to claim 1, wherein said outer cover includes a front wall, upper wall and side walls, and the electrical connector further comprises a bottom cover which is engaged with a bottom of the outer cover.

4. The electrical connector according to claim 3, wherein an assembly of the two housings and the holder is installed within said outer cover having an opened bottom, and the opened bottom of the outer cover is closed by the bottom cover.

5. The electrical connector according to claim 3, wherein said front wall of the outer cover has formed therein a plurality of terminal insertion holes into which the cooperating connecting terminals are insertable.

6. The electrical connector according to claim 1, wherein the two housings are engaged with the holder such that the open surfaces of the two housings face each other in a vertical direction.

7. The electrical connector according to claim 1, wherein the holder is arranged between said open surfaces of the two housings such that said locking portions of the holder are engaged with said contact portions of the connecting terminals, and an assembly of said connecting terminals, said two housings and said holder is supported by said outer cover.

8. The electrical connector according claim 1, wherein side plates are formed on both sides of the holder, and a plurality of engaging portions formed as claws are provided one on the other at front and rear portions of the side plates.

9. The electrical connector according to claim 8, wherein a plurality of engaging grooves are provided one on the other on both side portions of the front portion and the rear portion of each housing, and wherein the plurality of engaging portions of the holder are adapted to engage with the plurality of engaging grooves of the two housings.

10. The electrical connector according to claim 9, wherein when the plurality of engaging portions of the holder are engaged with the plurality of engaging grooves of the two housings, said final engagement is accomplished such that the locking portions of the holder are brought into contact with rear steps of the contact portions of the connecting terminals temporally engaged in the two housings, thereby preventing undesired backward movement of the plurality of connecting terminals.

11. The electrical connector according to claim 1 wherein a plurality of partition walls are formed, adjacent to the locking portions, on the upper surface and the lower surface of the holder for separating the plurality of connecting terminals.

* * * * *